United States Patent [19]

Petersen

[11] Patent Number: 5,042,230

[45] Date of Patent: Aug. 27, 1991

[54] SYSTEM, APPARATUS AND METHOD OF PACKAGING FLAT PRODUCT, PARTICULARLY FOLDED PRINTED PRODUCTS, IN PLASTIC FOILS

[75] Inventor: Godber Petersen, Augsburg, Fed. Rep. of Germany

[73] Assignee: Man Roland Druckmaschinen AG, Offenbach am Main, Fed. Rep. of Germany

[21] Appl. No.: 435,940

[22] Filed: Nov. 13, 1989

[30] Foreign Application Priority Data

Nov. 18, 1988 [DE] Fed. Rep. of Germany ..... 3838985

[51] Int. Cl.[5] ..... B65B 9/00; B65B 25/14; B65H 45/20

[52] U.S. Cl. ..... 53/452; 53/247; 53/455; 53/546

[58] Field of Search ..... 53/455, 452, 460, 473, 53/546, 545, 550, 202, 247, 539, 158

[56] References Cited

U.S. PATENT DOCUMENTS

| | | | |
|---|---|---|---|
| 2,918,769 | 12/1959 | Anderson et al. | 53/546 |
| 3,340,669 | 9/1967 | Farquharson | 53/455 |
| 4,004,400 | 1/1977 | Anderson et al. | 53/202 X |
| 4,299,075 | 11/1981 | Gram | 53/202 X |
| 4,370,844 | 2/1983 | Degn et al. | 53/202 X |
| 4,605,212 | 8/1986 | Kobler | 270/54 |
| 4,605,213 | 8/1986 | Hechler | 270/55 |
| 4,775,136 | 10/1988 | Petersen | 270/54 |
| 4,807,865 | 2/1989 | Kobler et al. | 270/54 |
| 4,871,159 | 10/1989 | Petersen | 270/55 |

FOREIGN PATENT DOCUMENTS 2354381 5/1974 Fed. Rep. of Germany .

*Primary Examiner*—James F. Coan

*Attorney, Agent, or Firm*—Frishauf, Holtz, Goodman & Woodward

[57] ABSTRACT

To provide for simultaneous wrapping or packaging of products, particularly flat, and especially folded printed products (1), in pockets, a foil or web (29) is pulled from a supply roll in a predetermined path over a plurality of cutter rails (23, 118) associated with pairs of holder elements (42, 42'-50). The so-pulled foil is continuously fed, even after it is stretched over the cutter elements, and a deflection bar or rail is passed between the holder elements to deflect the foil into zig-zag shape, to form reception pockets. The products are introduced into the pockets, the zig-zag shaped pockets are severed along a connection line and welded shut at the sides, as well as along the connection lines, for example by heat welding.

23 Claims, 18 Drawing Sheets

51
52
34
29
43
50
42
53
57
58
59
61
60
46
36
37
35
45
44
54
49
47
48
56
55

SYSTEM, APPARATUS AND METHOD OF PACKAGING FLAT PRODUCT, PARTICULARLY FOLDED PRINTED PRODUCTS, IN PLASTIC FOILS

The present invention relates to a system and to a method to individually package flat products, typically folded printed products, such as newspapers, magazines or the like, within a wrapper, for example a plastic foil wrapper.

BACKGROUND

Various processes and apparatus which are in use individually package flat products, typically printed products, by sequentially encasing the printed products, one after the other, within a foil. The operating speed of such apparatus is comparatively slow, even if the machine speed is increased continuously, by optimizing various operating parameters, and by the use of modern, usually electronic control apparatus. The number of wrappings per unit time is limited at the operating stations in which a certain minimum time for transport, positioning, and welding or adhesion together of web or foil material is required. In such instances, various wrapping apparatus or machines must be used in parallel in order to be able to reach a predetermined wrapping output of the overall system. Use of parallel machinery requires substantial financial investments, and also increases the space for the location of the apparatus. Such space is frequently expensive, or may not be available, in which case the overall operating speed of the system is decreased.

THE INVENTION

It is an object to provide a method, system and apparatus to permit packaging of individual flat products, typically folded printed products, in such a manner that a multiplicity of such products can be wrapped or packaged at the same time, and in which the packaging or foil-wrapping can be done by removing foil in web form from a supply source, such as a supply roll or supply reel.

Briefly, a foil or web is pulled out from a supply reel along a predetermined path. The pulled out foil or web is then deflected in zig-zag form, transversely to the foil path, to form a plurality of adjacently located V-shaped reception pockets which are connected at connection lines. The flat products are then, essentially simultaneously or rapidly sequentially, introduced into the pockets, and the deflected foil or web, as soon as the products are placed therein, are severed along the connection lines to form separate wrapping pockets for the respective products. The wrapping pockets are then closed at their open sides, for example along the prior, then severed connection lines and along open sides thereof.

This method can be carried out readily by an apparatus which, in accordance with a feature of the present invention, includes a holder to hold and pull a foil or web over an assembly of a plurality of holder elements which have associated therewith cutters. The holder elements are supplied in pairs. A transport system moves the holder structure for the web to pull it across the holder elements. Deflection elements, such as bars or rods are then pushed against the web, so that it will be deflected into zig-zag shape, held at, for example, upper regions by the holder elements and pushed downwardly by the deflection bars. This forms a plurality of zig-zag shaped portions which define V-shaped receptacle pockets for the products. The V-shaped pockets are connected along a connection line, at which line they are held. The deflection elements, such as the rods, are then moved out from the now deformed web to permit introduction of the products into the reception pockets, for example from zig-zag shaped holders described in detail in the cross references patents and, for example, specifically in U.S. Pat. No. 4,775,136, Petersen. The cutters then are operated to cut the foil along the connection lines, the paired holder elements holding the now cut foil portions in position. The foil portions, with the products inserted therein, are then closed by connecting the open sides together, for example by heat-welding plastic foil or by connecting the sides in any other suitable manner, by adhesives, or the like, so that the products are securely wrapped within the thus formed wrapping pockets.

The present invention has the advantage that it permits simultaneous or essentially simultaneous introduction of a large number of folded products into the preformed V-shaped reception pockets, for example from storage or transport elements which can release the products by dropping them into the reception pockets.

Preferably, the products are held in position in a predetermined spacing from each other, located parallel in a zig-zag holder arrangement, and positioned, after withdrawal of the deflection rods or deflection elements, above the V-shaped reception pockets. They can, thus, be fed into the reception pockets and, after separating the then still continuous V-deflected or zig-zag deflected foil into individual pockets, all the still open sides can be welded together at one time. It is, of course, possible to locate a plurality of such apparatus next to each other, so that in each one of the units, a predetermined number of flat products can be packaged at the same time. This system, thus, is particularly suitable for handling and packaging a very large number of printed products in the shortest possible time.

DRAWINGS

FIGS. 4 to 10 are enlarged fragmentary partial views of the apparatus of FIGS. 1 and 2, in which FIG. 8 is a section along line B—B of FIG. 7;

FIG. 9 is a sectional view along line C—C of FIG. 10;

DETAILED DESCRIPTION

Figure 1:
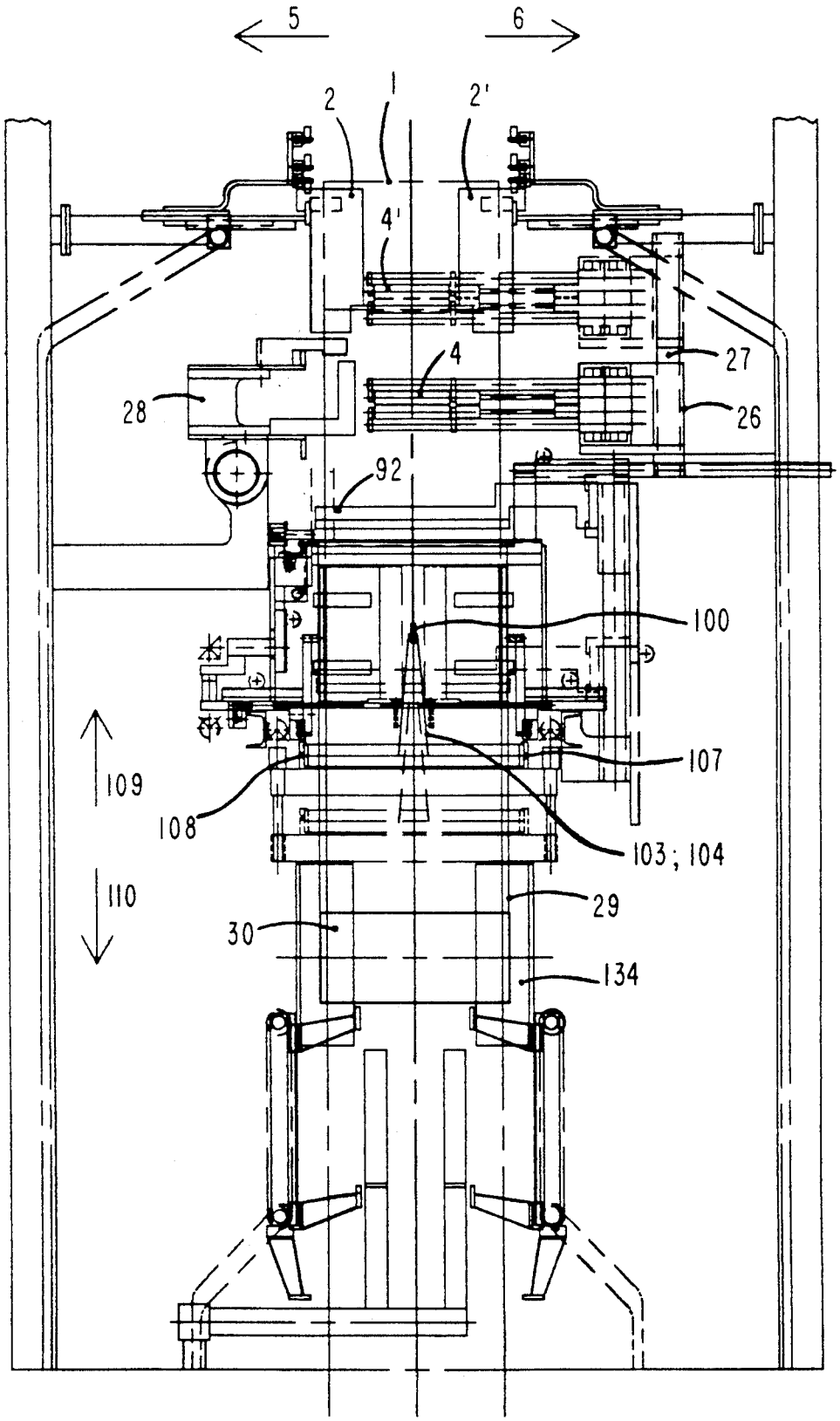
FIG. 1 is an overall front view of the system, omitting elements not necessary for an understanding of the present invention, and taken along the arrow A of FIG. 2.
Figure 2:
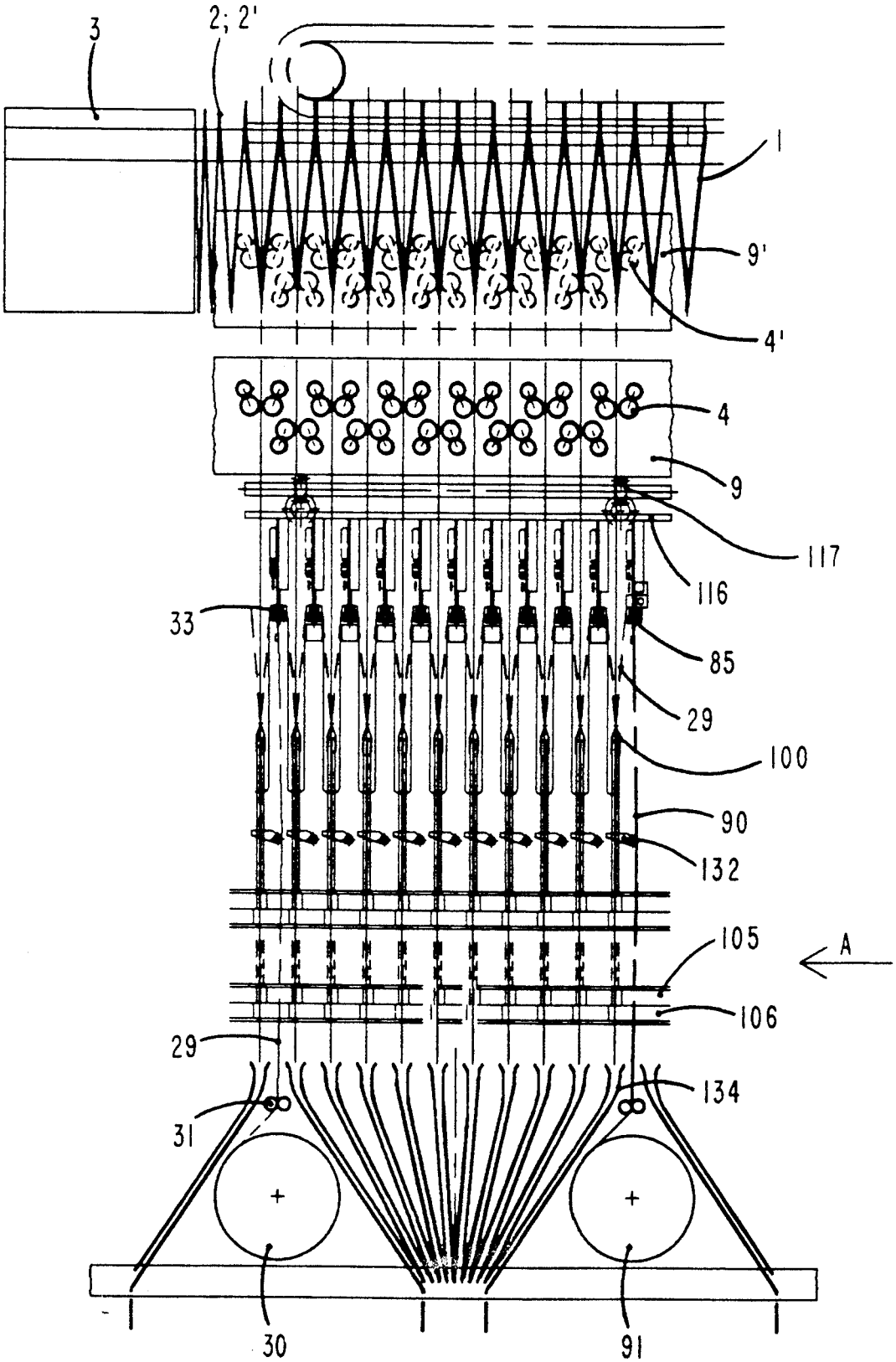
FIG. 2 is a side view of the apparatus of FIG. 1.

The basic system is best seen in FIGS. 1 and 2. The method of the present invention will also be described in connection with FIGS. 1 and 2. The apparatus is specifically adapted to be used in combination with the apparatus described in German Patent Disclosure Document DE-OS 36 44 423, to which U.S Pat. No. 4,871,159 corresponds. The packaging system is also particularly useful with an addressing apparatus described in German Patent Disclosure Document DE-OS 38 05 877, to which U.S. application Ser. No. 07/300,340, filed Jan. 23, 1989, PETERSEN, corresponds. A stacking or assembling apparatus can be used after the products have been packaged; a particularly suitable stacking and assembling apparatus is described in German Patent Disclosure Document DE-OS 38 11 289, to which U.S. application Ser. No. 07/329,798, filed Mar. 28,1989, PETERSEN, corresponds.

The present invention will be described in connection with the wrapping of printed products, such as folded newspapers, magazines, or the like, in plastic foil, although the invention is not restricted thereto.

Printed products 1, for example folded printed products derived from a paper handling and folding apparatus coupled to receive printed material from a printing machine, are located in a plurality of zig-zag storage structures 2, 2' which are retained in a cassette or holder 3 (FIG. 2). The zig-zag holders, with the printed products 1 therein, when stored in the cassette, are compressed to take up minimum space. For wrapping the products, the zig-zag holders 2, 2' are expanded, as shown in FIG. 2, upon being pulled out from the cassette, for example by a transport apparatus such as a belt or the like, which may have fingers thereon, as only schematically shown in FIG. 2, since this system does not form part of the present invention. The printed products may, while they are in the zig-zag holders 2, 2', and expanded as shown in FIG. 2, have inserts placed therein, for example in form of further printed insert products. If the products within the zig-zag holders 2, 2' first retain newspapers, for example carrying news reports, the inserts may include advertising material, local editions or the like. The printed products, after having been assembled, for example with inserts, can be carried downwardly by transport rollers after the zig-zag carrier structures 2, 2' are laterally deflected, as described in detail in the referenced patents and applications. The transport rollers 4 may, initially, be raised to the position shown at 4', and then, after gripping the printed products, be dropped to the position shown at 4 in FIG. 2. The storage structures 2, 2' are spread apart laterally in the direction of the arrows 5, 6 (FIG. 1) to permit release of the products held between the zig-zag holders 2, 2'.

Figure 9:
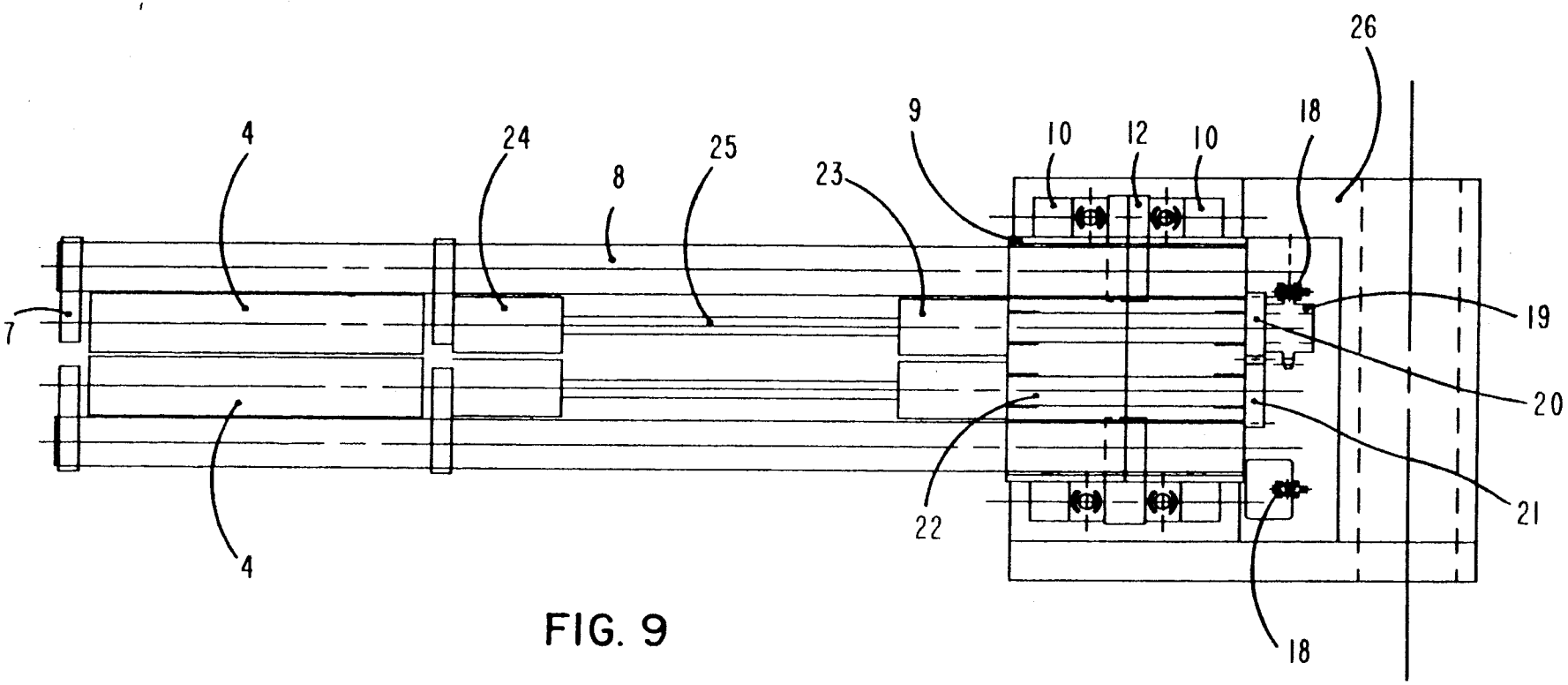
Figure 10:
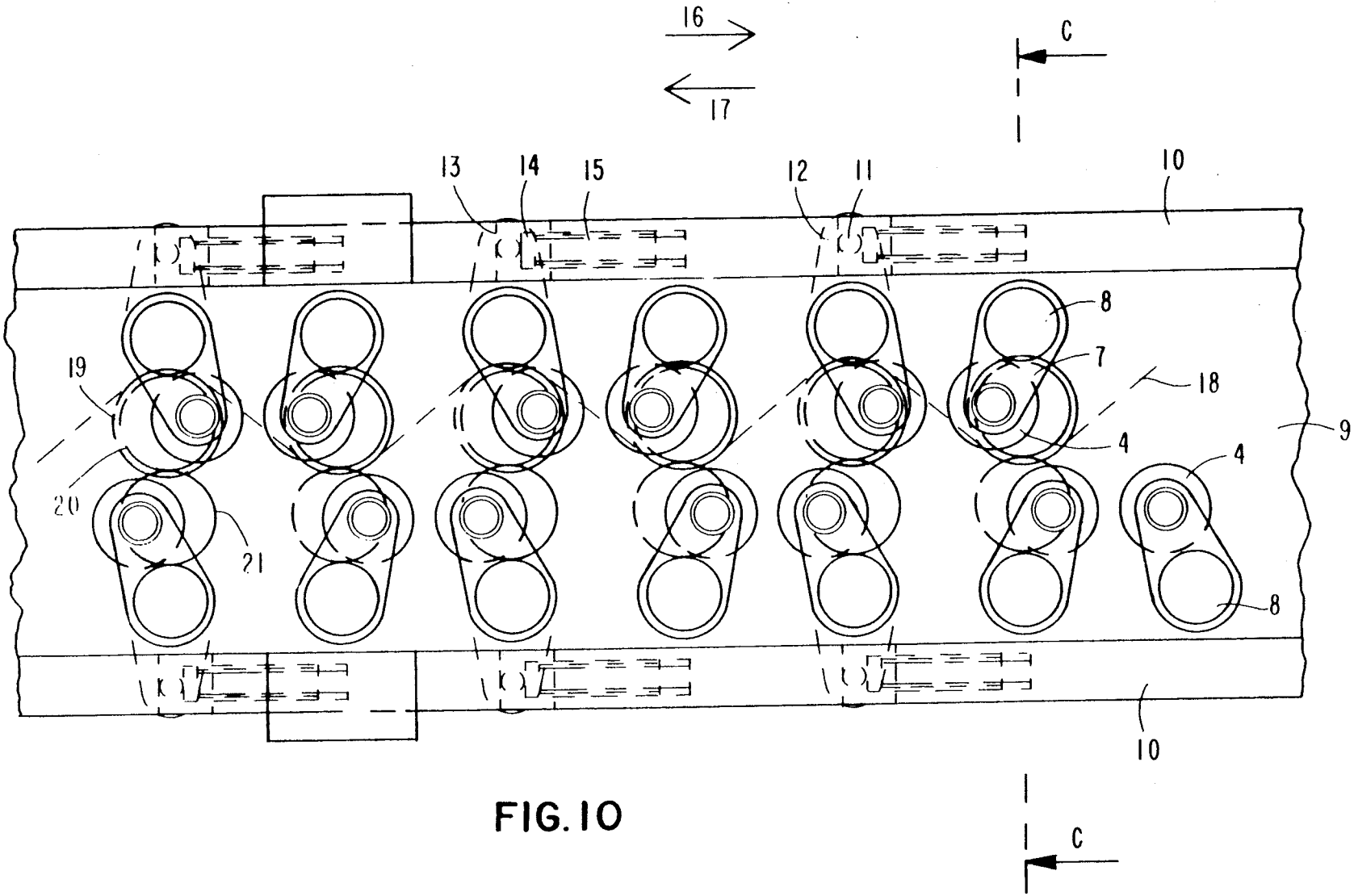

The drive arrangement for the transport rollers 4 is shown in detail in FIGS. 9 and 10, in which FIG. 9 is a view along the line C—C of FIG. 10, which illustrates an end view of the rollers, similar to the illustration in FIG. 2.

The transport rollers 4 are retained by links or levers 7, and pivotable on spindles 8. The spindles 8 are supported in a housing 9. Pivoting the levers 8 is done by pull rods 10, coupled to pins 11 and levers 12 secured to the spindles 8. The pins 11 are carried along by abutments or stops 13, 14. One of the stops is resiliently retained by means of a spring 15 (FIG. 10).

When the pull rods 10 are moved in the direction of the arrow 16 or 17, respectively, the transport rollers 4 are pivoted in opposite direction. A roller chain 18 (FIG. 9) and sprocket wheels 19 transfer drive movement to gears 20, 21 on shafts 22 and, further, transfer movement via elastic couplings 23, 24 and intermediate shafts 25 to the transport rollers 4. A holder 26 (FIG. 1) for the entire drive system is provided, movably located in a guide track 27, so that the rollers 4 can move between the upper gripping position 4' and the lower position 4.

A drive, not shown, is provided to shift the transport rollers between the positions 4' and 4, which, for example, can be an electric motor, secured to a frame of the entire apparatus, for up-and-down movement of the roller assembly. In the upper position, the printed products 1 are gripped, individually, by the rollers 4 when in position 4'. Upon downward movement of the entire roller-pivoting and drive assembly (FIGS. 9, 10), the transport rollers 4 will be in the full-line position shown in FIG. 2, that is, downwardly and, upon such movement, each one of the roller pairs 4 pulls a printed product 1 out from under the storage structure 2, 2'. Upon start of movement of the roller chain 18, the printed products are then fed further downwardly and may receive an addressing label, or otherwise be addressed by an addressing apparatus 28, and are then fed further downwardly, as not shown or described in detail since it is merely required to drive the rollers for downward movement.

In the selected example, ten printed products 1 are to be wrapped by a foil 29, rolled off from a foil supply reel 30 by drive rollers 31, see FIG. 2. The beginning portion of the foil or web 29 is held between a springy holding strip 32 (FIG. 16) and a counter cutter element, in form of a cutter bar 33. This is the first cutter bar over which the foil 29 is pulled. A plurality of cutter bars 33 are provided, all retained in side walls 34, 35 (FIG. 3) of the apparatus. The side wall 35 is secured by spacer holders 36 on an outer wall 37. The side walls 34 and 37 are secured by plates 38, 39 on support brackets 40, 41.

Figures 4, 5, 6:
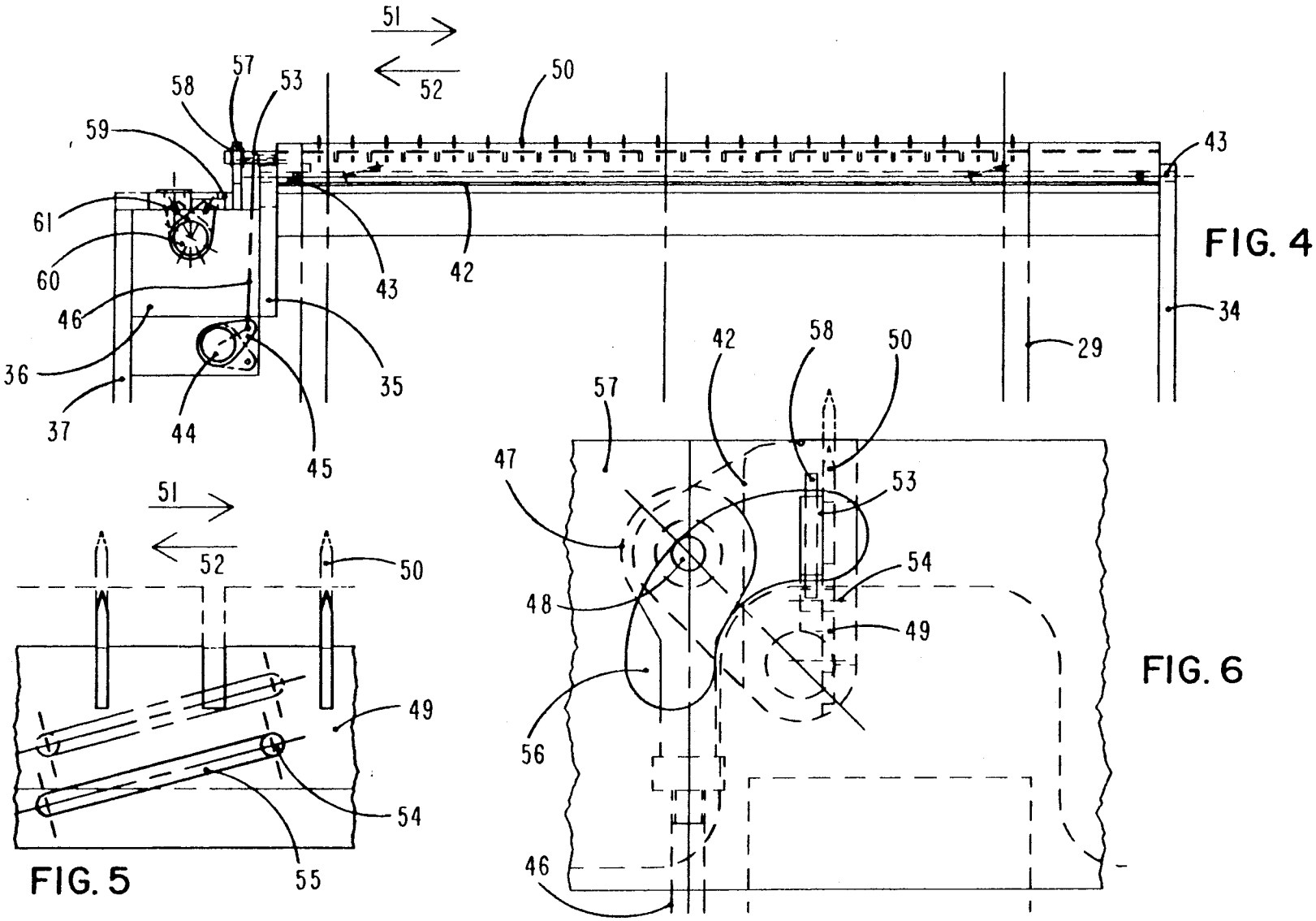
Figure 16:
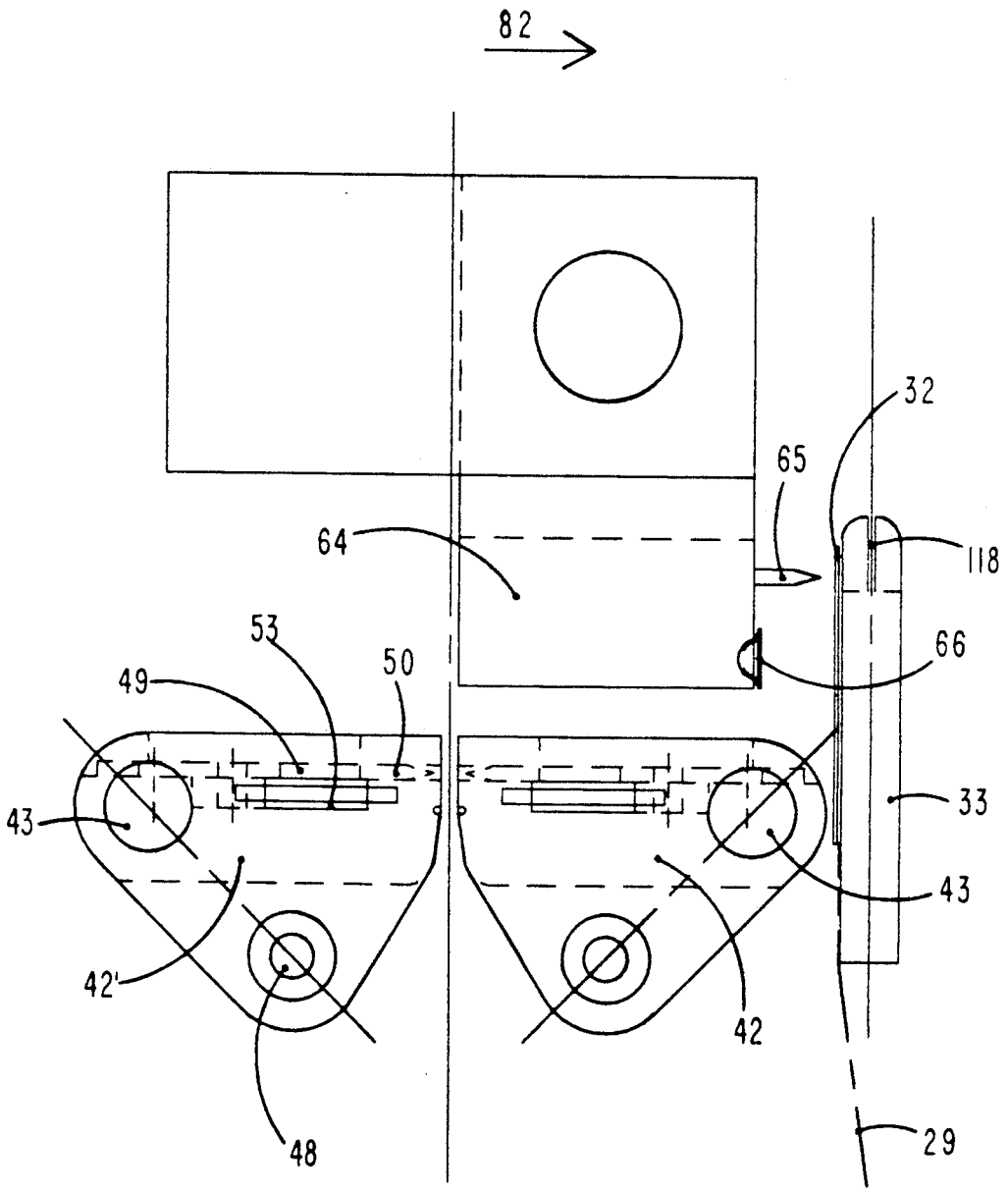
FIGS. 16 to 20 are enlarged fragmentary partial views of FIGS. 11 to 15.

FIG. 16 also shows the paired holder elements 42, 42', pivotable about a respective pin 43, retained in the respective side walls 34, 35. The holder elements 42, 42' can be pivoted, preferably, by about 90°, with respect and towards each other, as illustrated in FIG. 16. The pivoting movement is obtained, as best seen in FIGS. 4 and 6, by pivoting a spindle 44, which moves a lever 45, coupled to a link 46 which, in turn, is coupled to a joint element 47. The joint element 47 engages with pins 48 (FIG. 6) secured to the holder elements 42, 42'. This ensures that the holder elements 42, 42' are pivoted in unison towards and away from each other. The holder elements 42, 42' have movable needle strips 49 secured thereto, which can move up and down, furnished with needles 50. The up-and-down movement of the needle strips 49 is controlled by a reciprocating rail 53, moved in the direction of the arrows 51, 52, respectively (FIG. 4). Pins 54 secured to the rail 53 engage in inclined elongated holes 55 of the strip 49, in order to ensure reciprocating movement. The rail 53 engages a strip 57 through an elongated hole 56, guided by a pin 58. The elongated opening 56 permits pivoting of the strip 53, retained in a respective holder element 42, so that it may pivot by 90°.

The strip 57 also can be reciprocated in the direction of the arrows 51, 52 (FIG. 4) by the guide elements 59, being moved by lever 61 secured to a spindle 60. These movements permit the needles 50 to be projected or retracted, respectively, from the holder elements 42, 42', and permits this movement to be commanded at any angular position of the holder elements 42, 42', respectively.

Referring now to FIGS. 11 to 15 and, also, to the enlarged fragmentary portions from those FIGURES in FIGS. 16 to 20:

Foil is pulled off the roll or reel 30 by pull-off rollers 31 (FIG. 2). A needling strip 64 (FIG. 11) is located in an initial position shown in FIGS. 11 and 16. The needling strip 64 carries a series of needles 65 as well as small suction elements 66 to receive the initial portion of the foil web 29. The needling strip 64 is rotatably supported on a rack 67 (see FIGS. 7 and 8). The rack 67 is guided in a guide 68 (FIG. 8). Strips 69, 70 on guide surfaces 71, 72 of the strip 64 prevent its rotation. The guide 68 is located on guide elements 73 (FIG. 3) which also retain a drive for the rack 67. This drive is obtained from a pair of bevel gears 74 which are connected via a clutch 75 to a bevel gear pair 76 and then via gears 77, 78, 79 to the rack 67. The clutch 75, which also functions as a slide coupling, permits upward and downward movement of the drive with respect to the fixed bevel gear pair. Upward and downward movement is caused by a pinion 80 acting on a rack 81.

Figure 11:
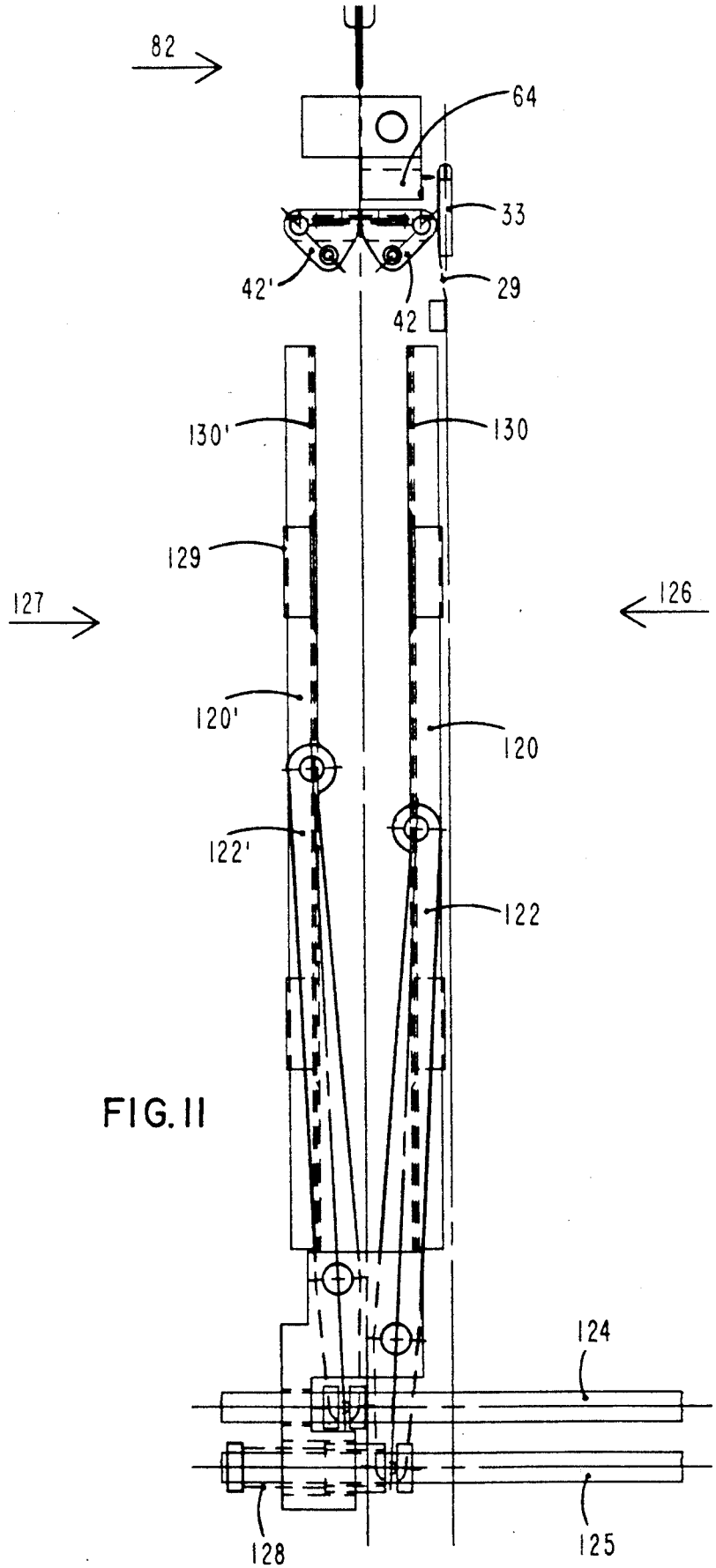
FIGS. 11 to 15 illustrate, schematically, the temporal sequence of the folding and foil welding steps when carrying out the method.
Figure 17:
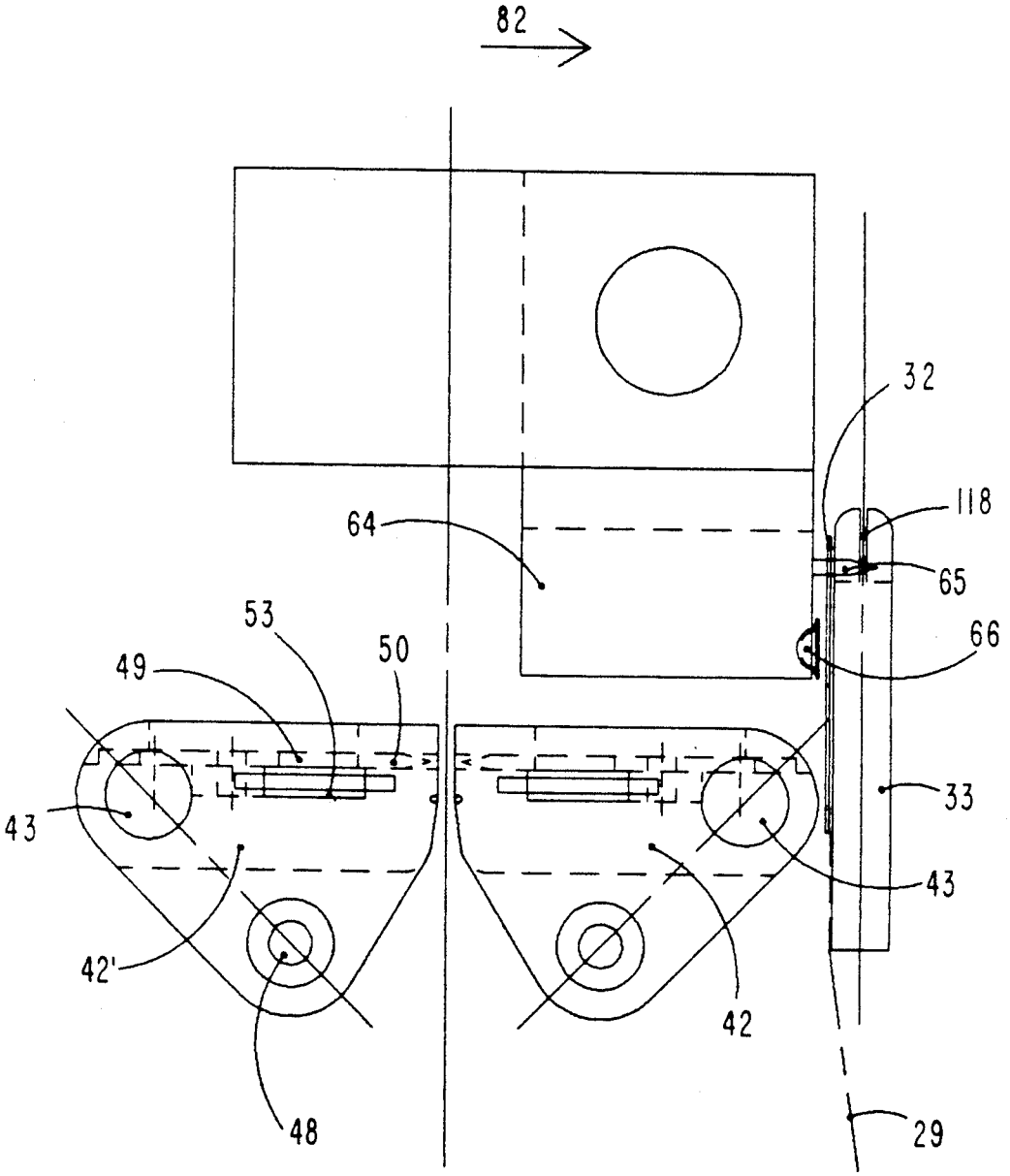

The needling strip 64 (FIGS. 11, 16) is first moved by the drive 74–79 in the direction of the arrow 82 from the position shown in FIGS. 11 and 16 in the position shown in FIG. 17 to receive the starting portion of the foil. This catches the foil starting end on the needles 65, and the suction element 66 is securely pressed on the foil web 29, to engage the foil web and hold it, by vacuum. The suction element 66 may, for example, be a suction cup.

The holder elements 42, 42' are in the position shown in FIG. 17, and the needles 50 thereof are in withdrawn position.

Figure 12:
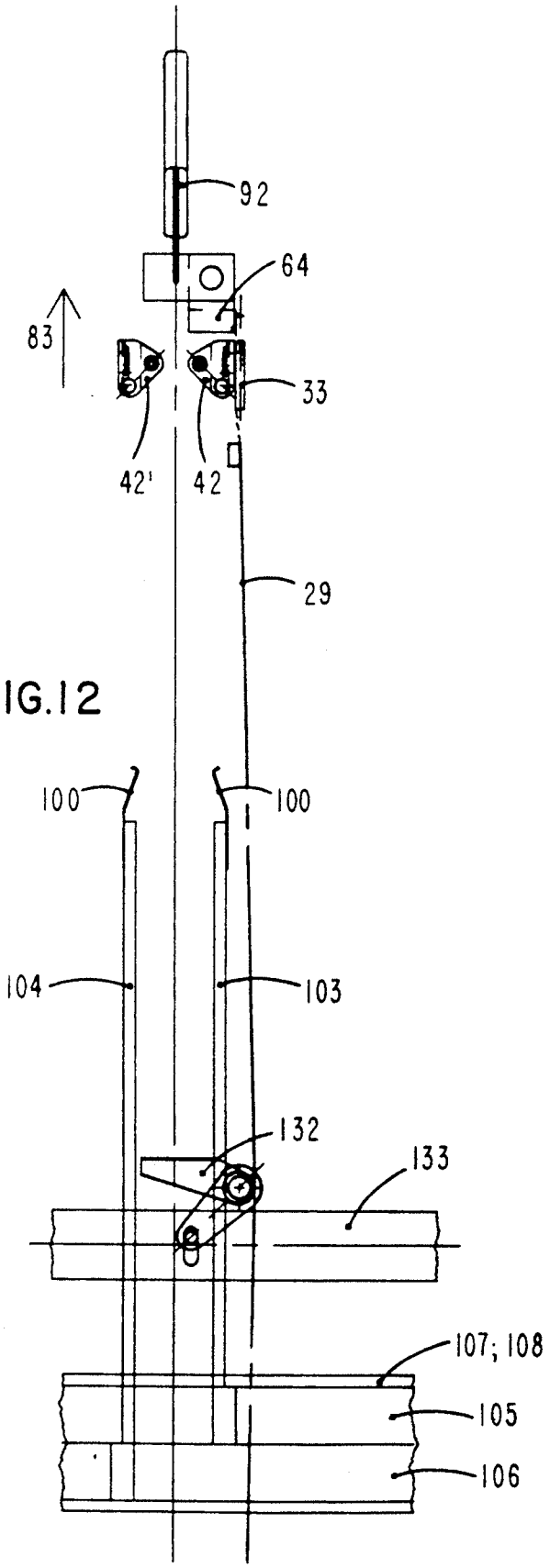
Figure 13:
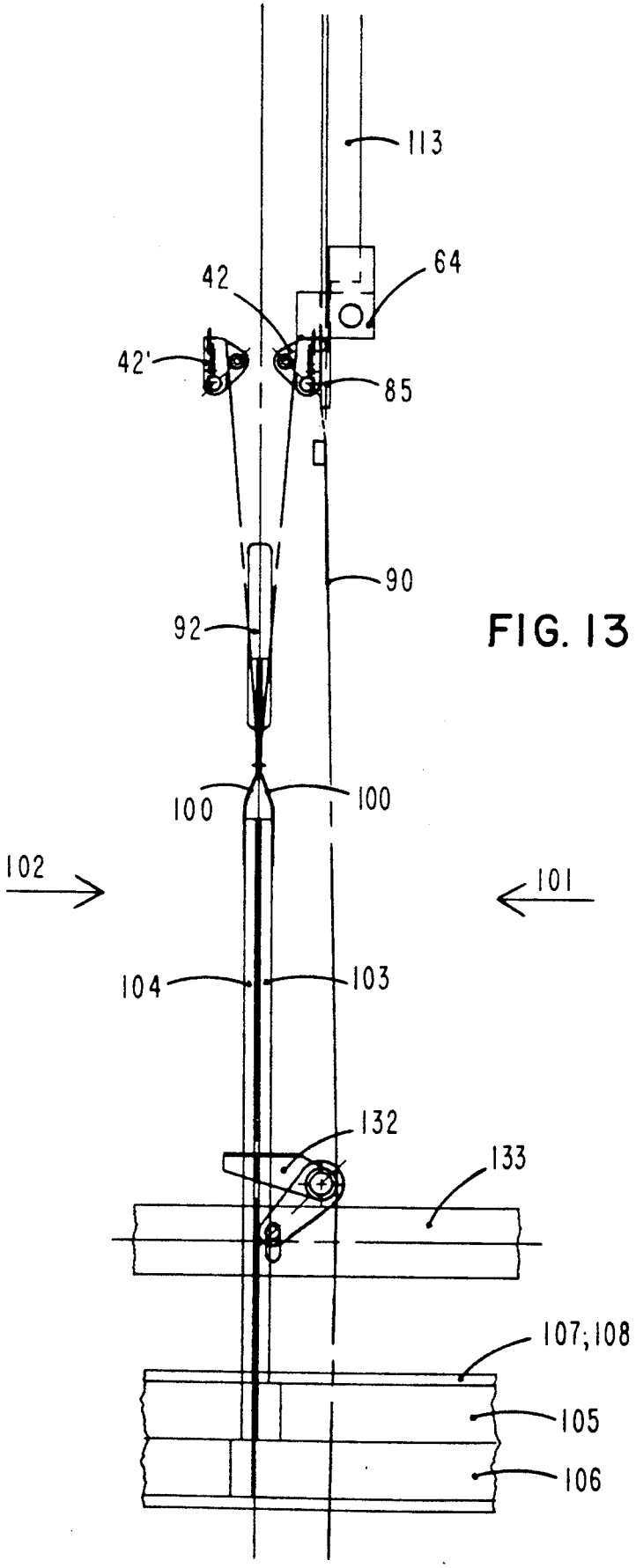
Figure 18:
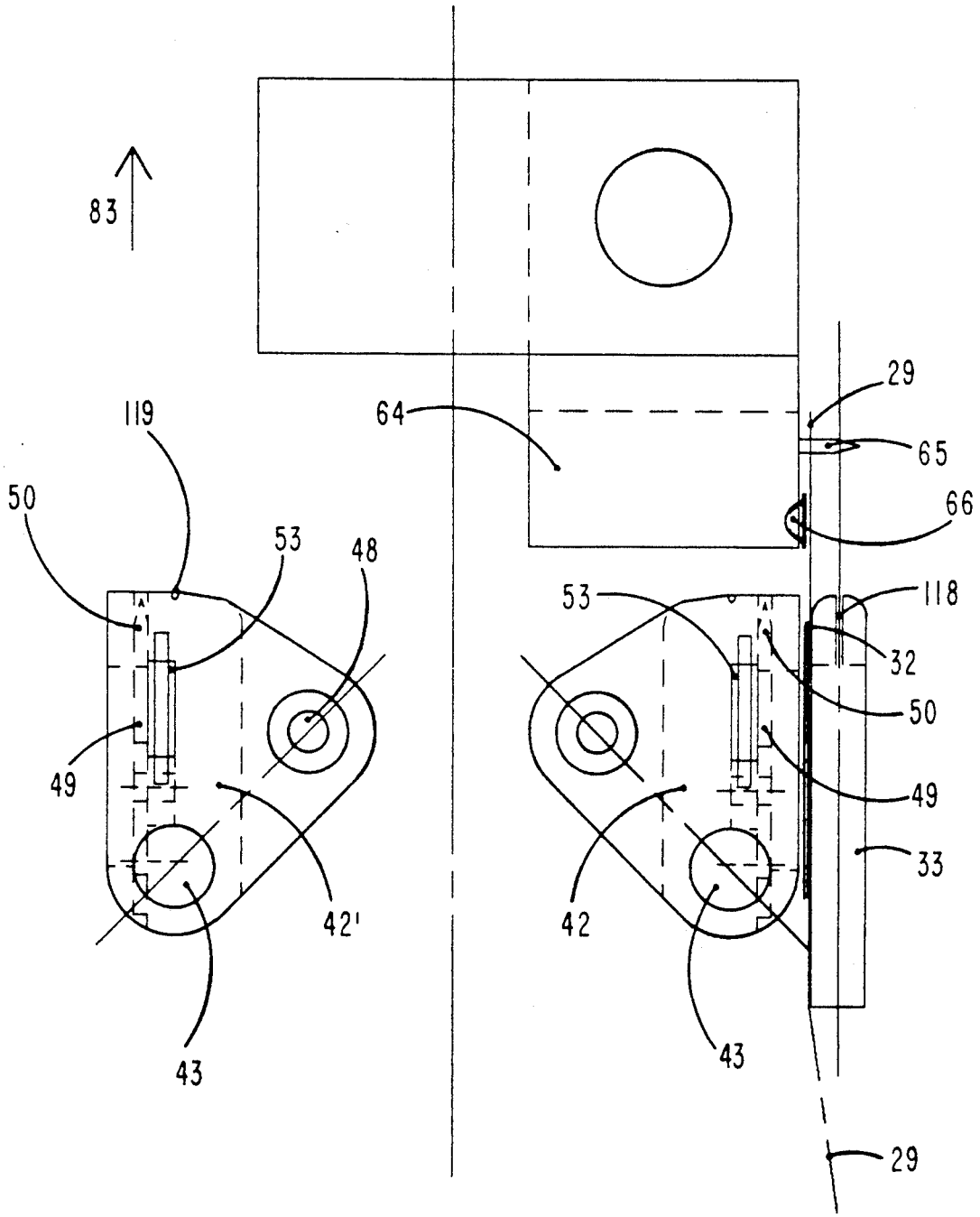

FIGS. 12 and 18 illustrate the position of the elements in a subsequent step. Upon upward movement in the direction of the arrow 83 by the drive 80, 81, the foil 29 is first pulled out by some distance, so that the holder elements 42, 42' can pivot upwardly from the position shown in FIGS. 16, 17 to the position shown in FIG. 18. The needles 50 remain in withdrawn position. In this position, shown in FIG. 18, of the needle strip 64, and the position of all the holder elements 42, 42', the needle strip 64 is projected upon starting of the drive 74–79 and, from this position, carries the web over the cutter bar 33 and over all the other nine cutter bars 33 (FIG. 2), with the associated holder elements 42, 42', in the direction of the arrow 84 (FIG. 7) up to the tenth cutter bar 85 (FIG. 2).

Figure 7:
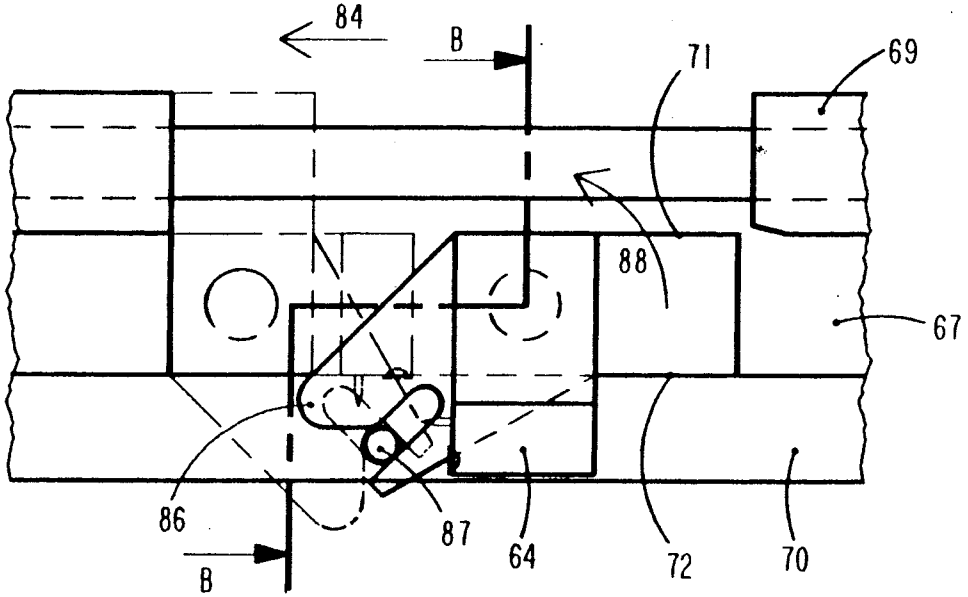
Figure 8:
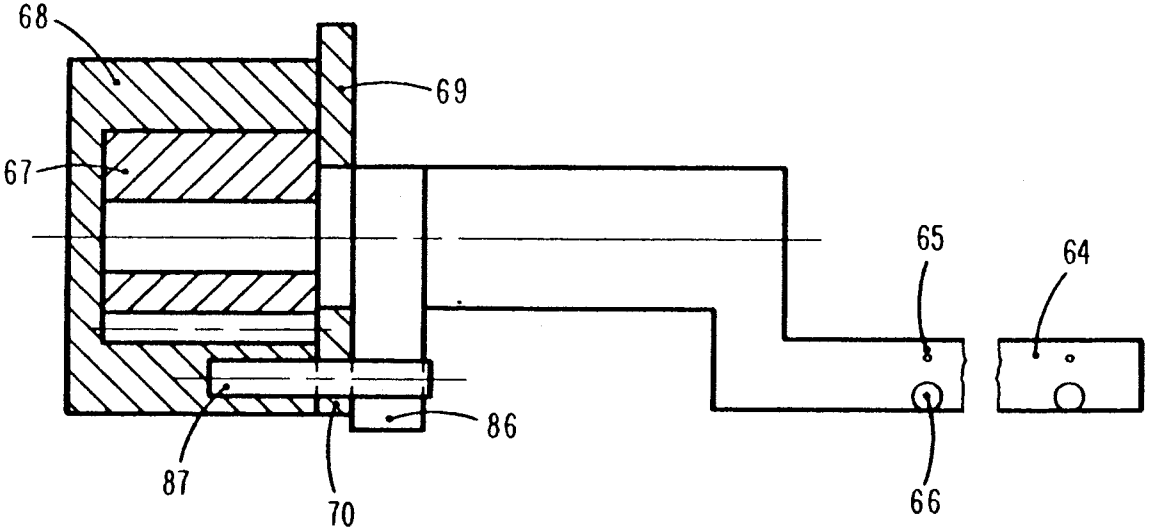

A latch 86 (FIG. 7), when reaching the tenth cutter bar 85 (FIG. 2), will reach the position shown in FIG. 7 and engage a pin 87. The guide strip 69, in that position, provides a free space above the surface 71, so that the latch 86, and hence the needle strip 64, can pivot, upon unchanged feed, in the direction of the arrow 84, about 90°, as shown by the arrow 88 in FIG. 7. It will, thus, reach the position shown in FIG. 7, which is the final position. FIG. 8 illustrates the arrangement when looked at in the direction of the arrow B of FIG. 7. The foil web 25 is prevented from slipping off the needles 65 by the suction cups 66. The drive 80 then moves the needle strip 64 downwardly on the holder elements 42, and specifically on the holder elements 42 associated with the last cutter strip 85. Preferably, the end of the foil is pinched between the needle strip 64 and the holder element 42.

As a consequence, all ten holder element pairs 42, 42' will have the foil 29 placed or spanned thereover. The drive rollers 31, upon movement of the needle strip 64 in the direction of the arrow 84, feed the foil from the reel 30 with the same speed as the feed movement of the needle strip 64.

In the next step (see FIG. 19), cutter strip 85, together with a resilient holding sheet 89, holds the next starting portion of the next foil 90, supplied from a subsequent foil roll 91 (FIG. 2) if, for example, a similar arrangement is used to package, or infoliate ten further products 1.

Figure 3:
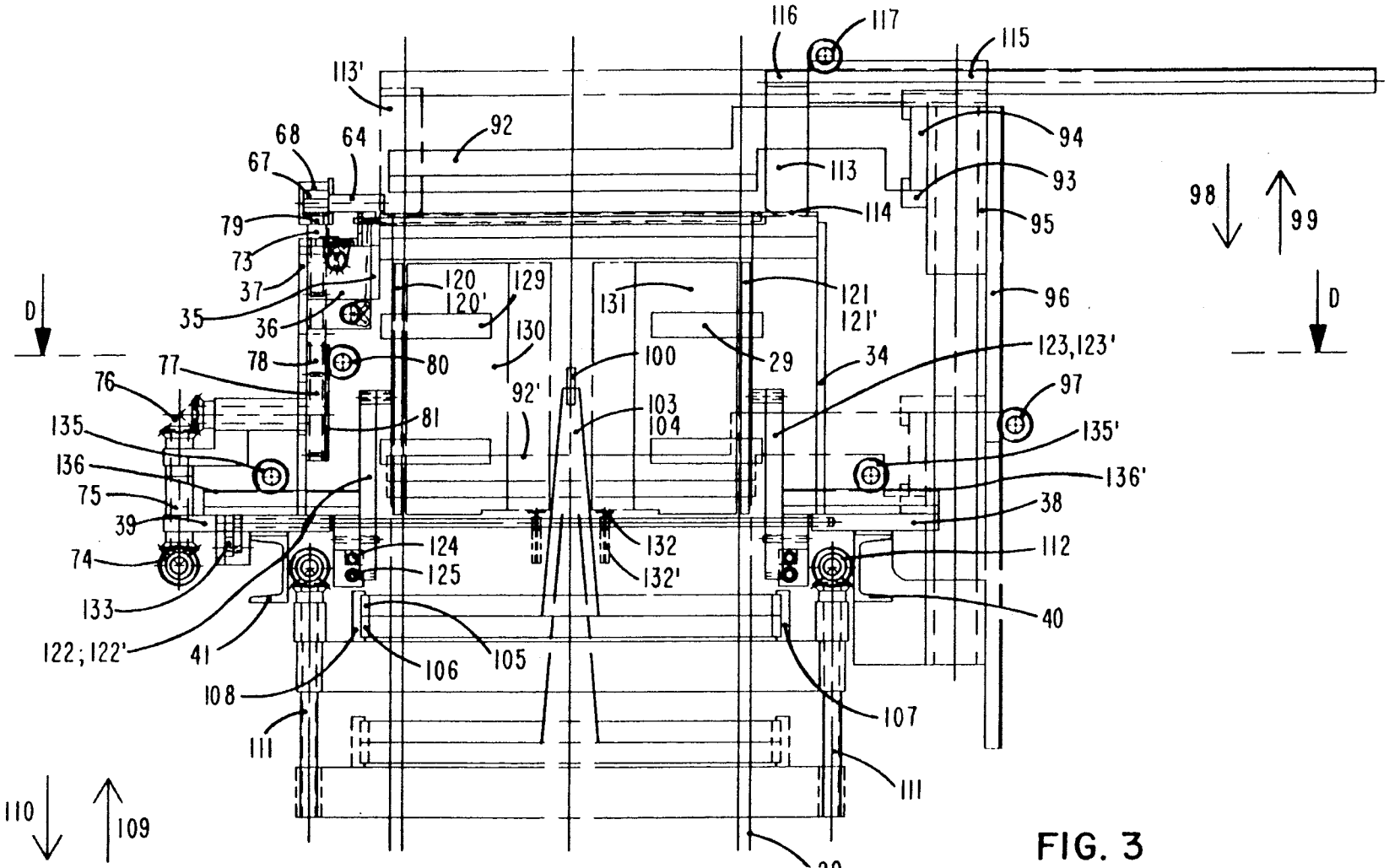
FIG. 3 is a fragmentary side view of the system of FIG. 1.

FIG. 3 illustrates rails 32, secured to a beam 94 movable on guides 93. The guides 93 are secured on a longitudinal guide element 95, which permits up-and-down movement in the direction of the arrows 98, 99 (FIG. 3), controlled by racks 96 coupled to a gear pinion 97. While the initial portion of the foil web 29 (FIG. 19) is retained, drive rollers 31 continue to feed the foil, and the rails or rods or bars 92, operating as deflection elements, are lowered by drive from the pinion 97 until they have reached the position shown in FIG. 13. In this position, clamps 100, having terminal clamping jaws, move towards each other in the direction of the arrows 101, 102 to temporarily pinch the foil web, and maintain them during a subsequent upward movement of the rods or rails 92, and hold them in the holding or final position shown in FIG. 14. The clamps or clamping jaws 100 are seated on holders 103, 104 (FIGS. 13, 14) which, in turn, are secured to longitudinally shiftable rails 105, 106. Rails 105, 106 are supported in guides 107, 108, as shown in FIG. 3. To be able to handle printed products which have different size, positioning spindles 111 and drives 112 can adjust the position of the guides 107, 108 in the direction of the arrows 109, 110 (FIG. 3), respectively. The rails 92 can be moved by selected distances, in dependence on the format of the printed products, so that they may move for different distances, with the final distance being shown at 92' in FIG. 3. It is desirable that all friction surfaces over which the foil may slide, that is, between the foil web and the holder elements 42, 42', as well as the rails 92, are of low friction material or have low friction surfaces, for example by suitable surface coating with a material of good sliding properties.

After the foil has been fed and pulled in, the position shown in FIG. 2 will be reached, in which ten V-shaped reception pockets for ten products will have been formed.

Figure 19:
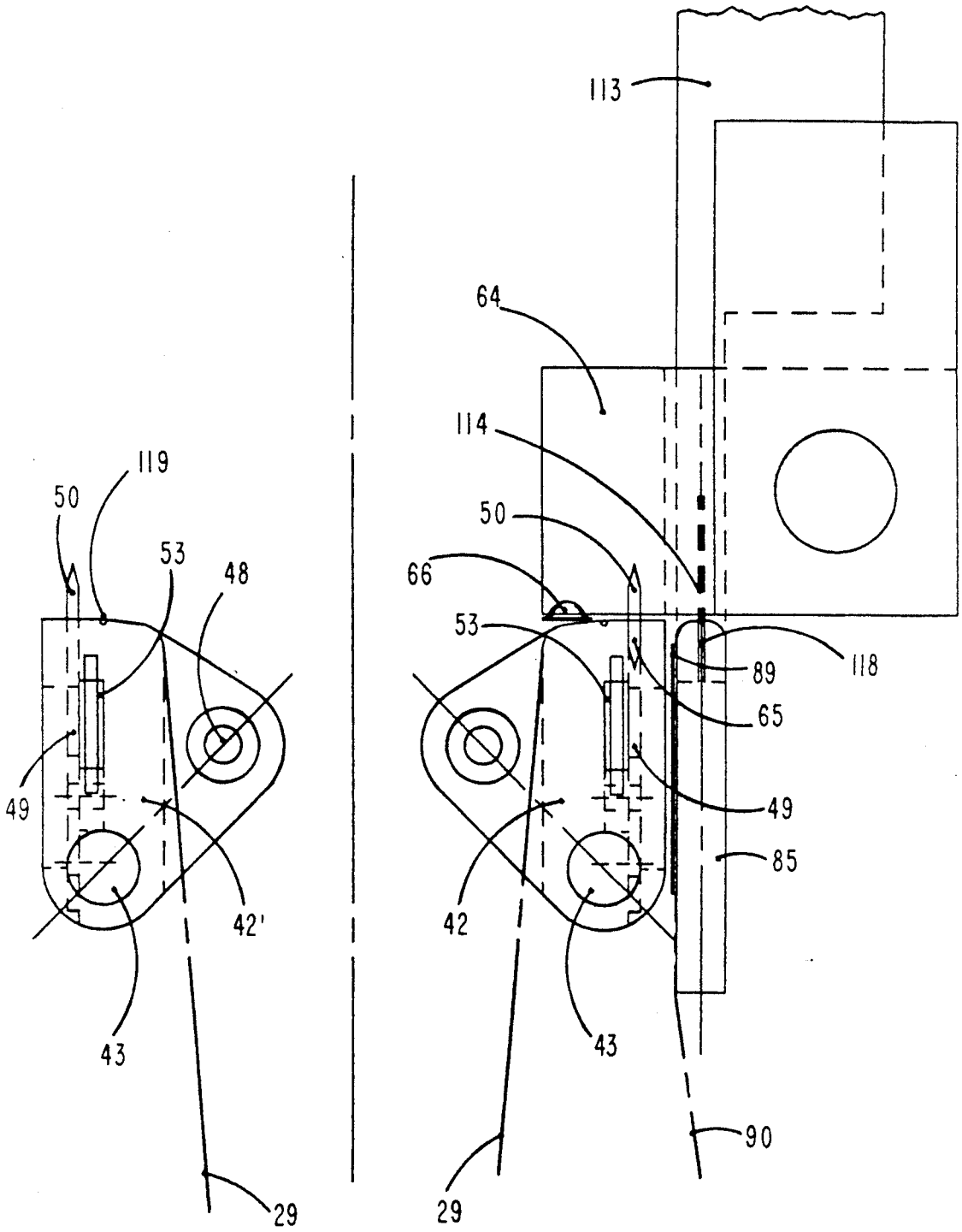

By simultaneous movement of all the strips 53 in the direction of the arrow 52 (FIG. 4), all the needle strips 49 are projected and hold the foil web 49 in position, as shown in FIG. 19. The clamps or clamping jaws 100 can again accept the position shown in FIG. 12, that is, in open position.

The printed products 1 are lowered by means of the rollers 4. A beam 94 is moved in its guides 93, so that the rails 92, for a short time, move to the position shown in FIG. 14 at 92'', so that they will not interfere with lowering or dropping and introduction of the printed products 1.

A beam or rail 116 (FIG. 3) retains thereon a plurality of knives 114 clamped in knife holders 113. The beam 116 is movable on a guide 115. The knife holders 113 (see also FIG. 19) are moved to the position 113' (FIG. 3) by a drive 117, for example a gear engaging a rack surface on the beam 116. The knives 114 (FIG. 19) engage the foil 29 and, by a counter cutting groove 118 in the cutting rail 33, sever the foil web at the same time along the folding lines about the cutter rails associated with the respective holder elements 42 of the holder element pairs, see FIG. 19, so that individual V-shaped reception pockets will result. After cutting, the rail 116, with the cutter holders 113 and the knives 114 thereon, is moved back to an initial position. The new end portion of the foil web 29, at that time, is held between the resilient holding sheet 32 and the first cutter strip or beam 33, as seen in FIG. 16.

Figure 14:
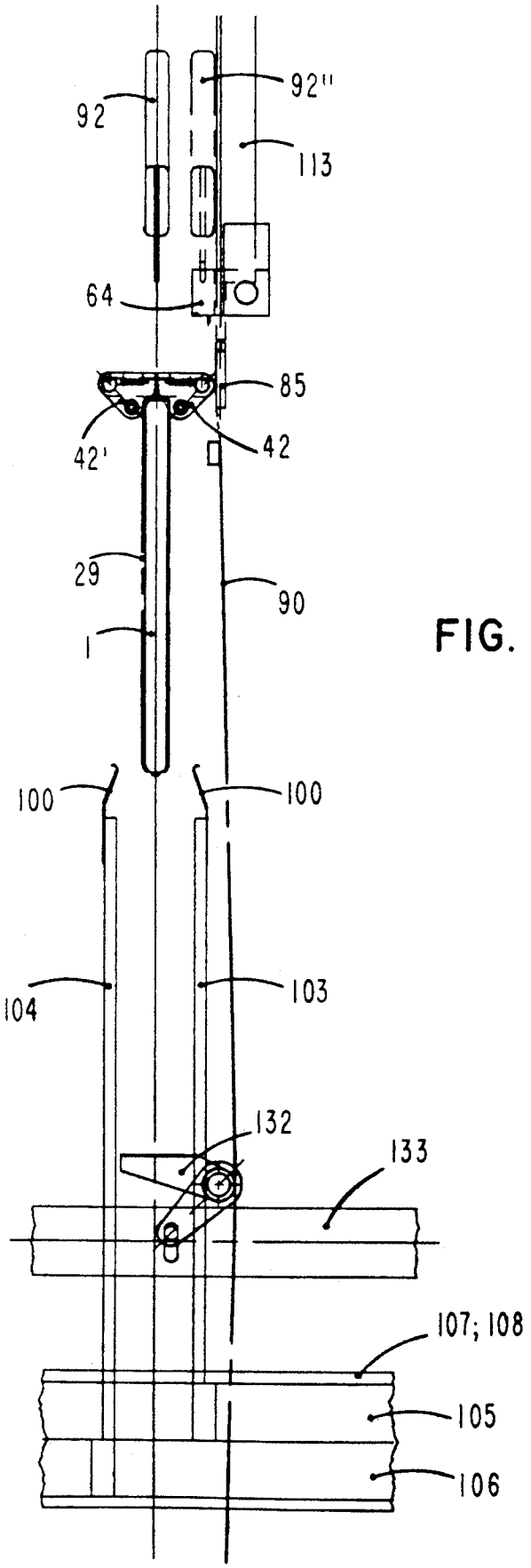
Figure 20:
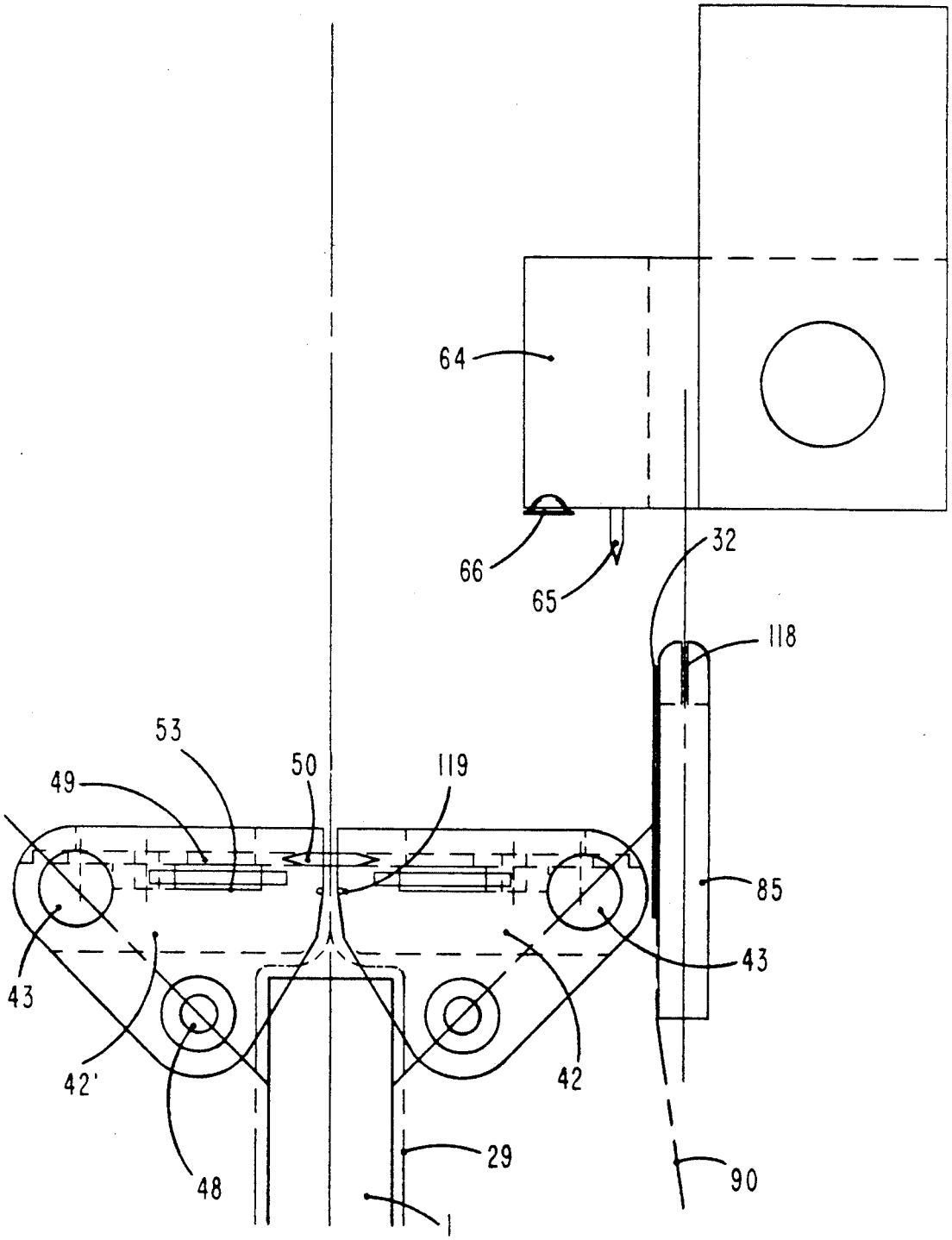

The needle strip 64 is moved in the position shown in FIGS. 14 and 20. The holder elements 42, 42' of the pairs pivot about 90° towards each other, see FIG. 20, and together form a holding arrangement to hold the severed foil end portions of the respective reception pockets, so that the end portions can be welded together by heat welding with a welding wire or strip 119. The needles 50, as soon as the welding is finished, are then withdrawn, and the holder elements 42, 42' are pivoted upwardly, briefly, in order to release the now tubular foil reception pocket.

Figure 15:
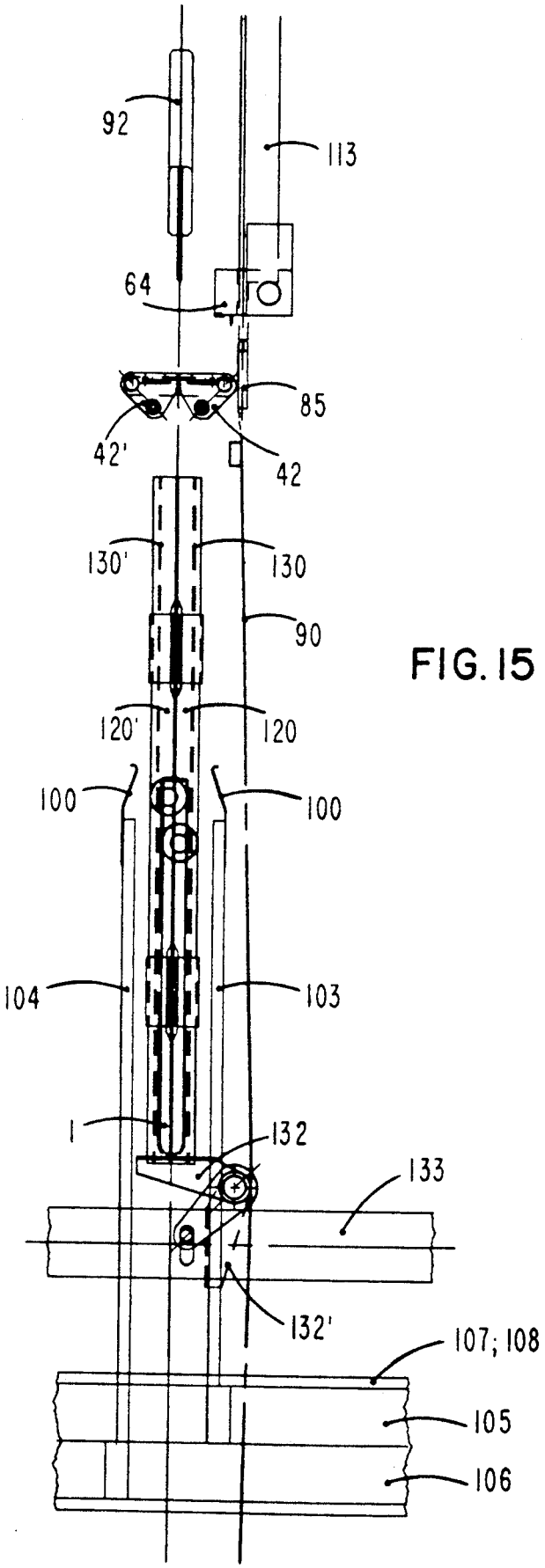
Figure 21:
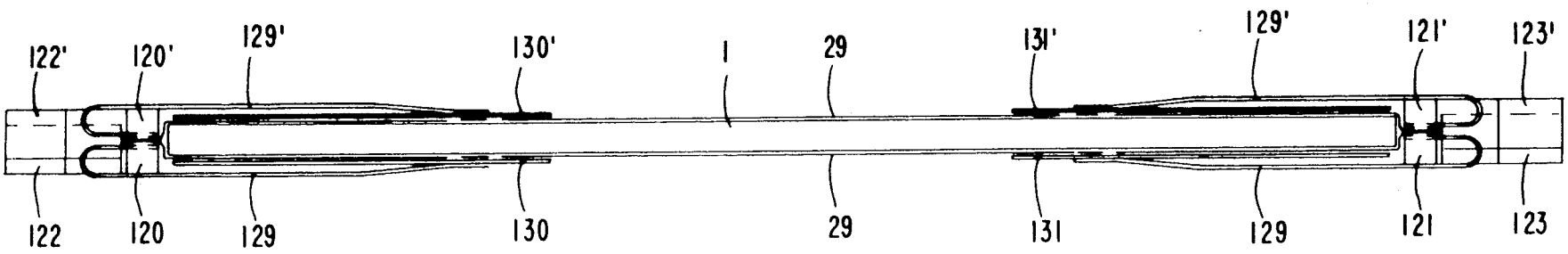
FIG. 21 is a section along line D—D of FIG. 3 during welding, that is, when carrying out the step illustrated in FIG. 15.

Lateral welding pairs 120, 120' and 121, 121' (see FIG. 3) are supported by arms 122, 122', 123, 123' and are moved towards each other by pull rods 124, 125, in accordance with the arrows 126, 127 (FIG. 11). The arms 122, 123 are resiliently engaged by compression springs 128. Sheet elements, for example flat metal sheets 130, 130', 131, 131', are resiliently retained by springs 129 in order to expel any air which may be between the foils, by engagement, with the foil interposed, against the printed product, as best seen in FIGS. 15 and 21. The welding jaws 120, 120', 121, 121' retain welding wires or similar heat welding elements in order to laterally weld the foil. Levers 132 prevent drop-out towards the bottom during the lateral welding operation. The levers 132 (FIG. 2) are pivoted downwardly after welding into the position 132' (FIG. 15) which is carried out simultaneously, under control of a movable strip 133. The printed products 1, after being released from the welding jaws 120, 120' and 121, 121', simultaneously, are supplied to a packaging apparatus, not shown since it forms no part of the present invention, by guide tongues 134 (FIGS. 1 and 2).

The final distribution or packaging arrangement, for example for bundling the enfoliated printed products, can be located beneath the guide tongues 134 which, preferably, are positioned in funnel-shaped arrangement as best seen in FIG. 2. The lateral welding jaws 120 and 121 can be adjusted for size by moving the pinion 135, 135' and the rack elements 136, 136' to permit welding in accordance with the lateral dimensions of the printed products.

The present invention has been described with respect to simultaneous enfoliation of ten printed products. Of course, any number, larger or smaller, of printed products can be wrapped by foil in a similar manner, and, likewise, a plurality of such arrangements can be located longitudinally, with respect to FIG. 2, next to each other or cascaded, so that many printed products can be individually enfoliated in minimum time by simultaneous wrapping. Since the path of the foil, and deflection by the deflection beams 92, should not be excessively long, pull-out of the foil to enfoliate printed products substantially more than, for example, ten from any one foil, may be time-consuming. It is, therefore, preferred to enfoliate only a limited number of printed products from any one foil and, hence, FIG. 2 shows the arrangement in which two foil supply rollers 30, 91 supply individual foils 29, 90, each one for a lesser number than printed products which can be stored in a cassette 3 and the zig-zag storage elements 2, 2'.

The present invention is preferably used, and especially suitable for packaging and enfoliating flat printed products; it may be used, however, also for packaging of other products which are not necessarily flat, for example in the food packaging field. The invention is also particularly applicable to enfoliate flat products such as phonograph records, compact discs, replacement cover elements for containers, such as beverage containers and the like, or any other article, and especially for such articles which have essentially flat surface regions.

The invention has been described in connection with enfoliating by a plastic foil which is heat-weldable; of course, other materials may likewise be used and enfoliated by the method and system of the present invention. For example, if paper or textile foils or webs are supplied, the closing of the respective reception pockets to form the wrapping pockets then can be carried out, as well known, by adhesives, staples, or the like; it is only necessary to replace the heat or sealing wires 119 and heating jaws 120, 120', 121, 121' by suitable adhesive supply rollers, stapling apparatus or the like.

Various changes and modifications may be made within the scope of the inventive concept.

I claim:

1. Apparatus for packaging flat products, particularly folded printed products (1), into a foil or web wrapping pocket, comprising a holder means (64, 65, 66);

a foil or web (29) attachable on said holder means;

a plurality of pairs of holder elements (42, 42'–50);

a plurality of cutter means (33, 118), respectively associated with the pairs of holder elements;

transport means (63, 73–79) coupled to the holder means (64, 65, 66) for pulling the foil or web (29) over the pairs of holder elements (42, 42'–50) and the associated cutter means (33, 118);

deflection means (92) engageable with the web and movable between the holder elements (42, 42'–50) forming a pair for deflecting the web into a plurality of zig-zag shaped portions which define V-shaped reception pockets for the product, connected at connection lines;

means for moving the deflection means between positions intermediate the holder elements of the pair, and remote therefrom, to permit introduction of the products into the reception pockets;

cutter operating means for said cutter means (33, 118) to sever the foil or web at the connecting lines into foil portions;

means for engaging the holder elements (42, 42'–50) of the pairs with the foil or web portions severed by said cutter means and holding said foil or web portions in position; and closing means (119, 42; 119, 120) engageable with free ends of the portions of the foil or web to form wrapping pockets within which the introduced products (1) are retained.

2. The apparatus of claim 1, wherein the holding means (64, 65, 66) include needles (65) and suction means (66) to engage and hold an end portion of the foil or web (29; FIG. 16);

and a first cutter element (33) forming part of said cutter means (33, 118), said transport means guiding the holding means across said first cutter element (33) and then over a plurality of further cutter elements (33, 118) forming part of said cutter means and respectively associated with said pairs of holder elements, said holder elements and said cutter elements being located longitudinally of a transport path through which said transport means (63, 73–79) moves the holder means.

3. The apparatus of claim 1, wherein said holder means (64, 65, 66) comprises a rail element (64) extending essentially transversely of said foil or web (29) having means (65) thereon for engaging and retaining said foil or web;

said transport means (63, 73–79) moving said rail across said plurality of cutter means (33, 118) and the pairs of holder elements (42, 42'–50), and further moving said rail element (64) towards the last holder element (42) of said pairs, in the direction of movement of the transport means and positioning said rail element to place an end portion of the foil or web (29) retained on said engaging means (65) of said rail element in clamped position to securely hold said foil or web and permit engagement of the deflection means (92) with said foil or web to form said V-shaped reception pockets.

4. The apparatus of claim 3, wherein said rail element (64) is pivotable for pulling said foil or web (29) and placing the end of the foil or web above a cutting groove (118) forming part of said cutter means associated with the last one, in the direction of movement of said transport means, of said pairs of holder elements (42, 42'–50).

5. The apparatus of claim 1, further including gripping means (FIG. 13: 100) gripping the lower region of the V-shaped reception pockets upon formation thereof by said deflection means (92), said gripping means temporarily holding the V-shaped region of said reception pockets;

said deflection means (92) being movable for withdrawal from said reception pockets, after formation thereof, while the V-shaped reception pockets are held, adjacent the apex of the V, by said gripping means;

and wherein said deflection means are movable from a position between said holder elements of the pairs to a withdrawn position and remote from the position between the holder elements to permit introduction of the products into the reception pockets, said withdrawn position (FIG. 14: 92'') being located laterally of said reception pockets.

6. The apparatus of claim 1, wherein said holder elements (42, 42'–50) and said cutter means (33, 118) respectively associated with the pair of holder elements include a pair of respectively oppositely pivotable carrier elements (42, 42'), pivotable about an axis (43) for clamping the foil portions after the cutter means has severed said V-shaped reception pockets and holding them against each other to permit said closing means (119, 42; 119, 120) to connect said severed foil portions together essentially along the severed connection lines.

7. The apparatus of claim 6, wherein said carrier elements (42, 42') include a needle strip or rail (49) carrying a plurality of needles (50);

and needle operating means (53, 54, 55) engageable with said needles for respectively projecting and retracting the needles from said needle strip or rail.

8. The apparatus of claim 7, wherein said operating means include a rail element (53), elongated inclined camming means (55) formed on the needle strip or rail (49), and cam follower means (54) engageable with said camming means, said rail element being positioned parallel to said needle strip or rail for engaging the needles and selectively moving the needles to projected or retracted position with respect to said needle strip or rail.

9. The apparatus of claim 7, wherein said means for engaging the holder elements (42–50) of the pairs for holding said foil portions in position include said needle strip or rail (49) and said needle operating means (53–55), said needles being moved to projected position to hold the end portions of the foil or web (29) in position after severing thereof along the connection lines;

and said means for engaging the holder elements (42, 42') are movable towards each other for clamping the severed ends of the portions of the foil or web together to permit said closing means to close said free ends.

10. The apparatus of claim 1, further including a movable cutting knife (114) associated with each one of said cutter means (33, 118), said cutter means including, each, a cutter rail (33) formed with a cutting groove, in which said cutting knife (114) is movable, for severing the V-shaped reception pockets along the respective connection lines.

11. The apparatus of claim 1, wherein said foil or web is heat-weldable;

and wherein said closing means comprises a heat welding means (119), each, associated with a respective pair of holder elements for transverse welding of the V-shaped reception pockets to form said wrapping pockets.

12. The apparatus of claim 11, wherein said heat welding means comprises a heat welding wire (119).

13. The apparatus of claim 1, further including air expulsion sheets (130, 131) engageable with the sides formed by the V-shaped reception pockets for expelling air from between said V-shaped reception pockets, and operating means (FIG. 11: 124, 125) for moving said air expulsion sheets towards each other and expel air from beneath said V-shaped reception pockets prior to operation of said closing means.

14. The apparatus of claim 1, wherein said holder elements (42, 42'–50) includes a needle strip or rail (49) carrying needles (50) thereon;

and carrier means (FIG. 3: 34, 35) pivotably securing said needle strip or rail.

15. The apparatus of claim 1, further including movable support means (FIG. 15: 132) positioned beneath the reception pockets to support the reception pockets, with the products (1) therein after severing of the web or foil (29) by said cutter means and during operation of said closing means.

16. The apparatus of claim 1, further including respectively expandable and compressible zig-zag holder and storage means (2, 2') retaining the products therein and positioned for transport of said products into the V-shaped reception pockets.

17. The apparatus of claim 1, further including transport rollers (4) movable, respectively, into and out of engagement with said products to remove said products from a storage means (2, 2').

18. The apparatus of claim 17, further including guide means (27) for shifting said transport rollers (4) from a removal position in which said transport rollers are engageable with the products (1) in the storage means (2, 2') and a delivery position located above the pairs of holder elements and the associated cutter means for delivering said products after formation of the V-shaped reception pockets.

19. The apparatus of claim 18, further including an addressing means (28) located adjacent the delivery position of the transport rollers (4);

and further including a transport roller drive (18, 19, 20) movable between said positions of the transport rollers with said transport rollers.

20. A method of packaging products, particularly flat products and especially folded printed products (1), comprising pulling a foil or web (29) from a supply roll over a predetermined path;

deflecting said pulled foil or web in zig-zag shape transversely to said path to form a plurality of V-shaped reception pockets connected at a plurality of connection lines;

essentially simultaneously introducing the products into said pockets;

severing the deflected foil or web at said connection lines to form separate wrapping pockets; and closing the open sides of said wrapping pockets.

21. The method of claim 20, wherein the step of pulling the foil or web from the supply roll in said predetermined path comprises pulling said foil or web over a plurality of pairs of holder elements (42, 42'-50) and cutter means (33, 118) respectively associated with the holder elements;

and further including the step of continuing to feed said foil or web from the supply roll after the foil or web has been pulled over said holder elements and cutter means to permit subsequent deflection of said pulled foil or web between the holder elements of the pairs to form said reception pockets.

22. The method of claim 20, including the steps of aligning a plurality of products (1) with said V-shaped reception pockets; and essentially simultaneously feeding said products into said pockets along an essentially linear path.

23. The method of claim 20, including the step of securing the foil or web along the connection line at the last one, in the direction of the predetermined path, of the reception pockets to permit engagement and pulling of the foil or web (29) from the supply roll and enable repetition of the steps set forth in claim 20.

* * * * *